US007207931B2

(12) United States Patent
Boland

(10) Patent No.: US 7,207,931 B2
(45) Date of Patent: Apr. 24, 2007

(54) MULTI-FUNCTION EXERCISE DEVICE

(76) Inventor: Kevin O. Boland, 5623 Massachusetts Ave., Bethesda, MD (US) 20816

( * ) Notice: Subject to any disclaimer, the term of this patent is extended or adjusted under 35 U.S.C. 154(b) by 16 days.

(21) Appl. No.: 11/097,916

(22) Filed: Apr. 4, 2005

(65) Prior Publication Data

US 2005/0221965 A1 Oct. 6, 2005

Related U.S. Application Data

(60) Provisional application No. 60/559,050, filed on Apr. 5, 2004.

(51) Int. Cl.
*A63B 21/02* (2006.01)

(52) U.S. Cl. ..... 482/126; 482/121; 482/124

(58) Field of Classification Search ..... 482/121, 482/122, 124, 126, 72, 74, 123, 127, 129, 482/910; D21/692, 693
See application file for complete search history.

(56) References Cited

U.S. PATENT DOCUMENTS 3,162,441 A * 12/1964 Karlik ..... 482/124
4,645,204 A * 2/1987 Berger ..... 482/123
4,961,573 A * 10/1990 Wehrell ..... 482/74
5,484,368 A * 1/1996 Chang ..... 482/122
5,540,642 A * 7/1996 Sprague ..... 482/123
2003/0022770 A1* 1/2003 Lee ..... 482/136
2003/0153441 A1* 8/2003 Berns et al. ..... 482/128

* cited by examiner

*Primary Examiner*—Jerome Donnelly

*Assistant Examiner*—Allana Lewin

(74) *Attorney, Agent, or Firm*—Richard L. Huff

(57) ABSTRACT

An exercise device for exercising different groups of arm muscles. The device is hollow, having front and rear curved walls and top and bottom longitudinal pieces. The top and bottom longitudinal pieces have a series of tension-adjustment anchor holes. Anchors are removably attached to the anchor holes. Elastic ropes are secured at one end to the anchors and at the other end to handles. The ropes go from the anchors, around pulleys, across the length of the device, around another set of pulleys, across the length of the device, and out the exit holes in ferrules to attach to the handles. The ropes may attach to the handles axially or perpendicularly.

12 Claims, 5 Drawing Sheets

MULTI-FUNCTION EXERCISE DEVICE

CROSS-REFERENCE TO RELATED APPLICATIONS

This application claims the benefit of the filing date of provisional application 60/559,050, filed Apr. 5, 2004.

STATEMENT REGARDING FEDERALLY SPONSORED RESEARCH OR DEVELOPMENT (Not applicable)

REFERENCE TO SEQUENTIAL LISTING, A TABLE, OR A COMPUTER PROGRAM LISTING APPENDIX SUBMITTED ON A COMPACT DISC (Not applicable)

BACKGROUND OF THE INVENTION

1) Field of the Invention

The field of this invention is portable exercise devices which offer a variety of arm exercises.

2) Description of the Related Art

The prior art contains portable exercise devices which provide for arm exercises.

U.S. Pat. No. 4,540,173, issued to Hopkins Sep. 10, 1985, discloses a hollow cylindrical housing which partially encircles the user's waist. An elastic cord enters and exits the housing, encircles the user's waist, and enters and exits the housing again. Each end of the cord has a looped handle. The handles may be pulled in different directions to exercise different muscle groups.

U.S. Pat. No. 5,433,688, issued to Davies Jul. 18, 1995, discloses a portable exercise device for exercising the upper body. The device contains a belt which surrounds the user's waist. The center of an elastic cord is attached to the front of the belt. The ends of the elastic cord are attached to gripping members. The handles of the device may be extended to exercise the arms or upper body.

U.S. Pat. No. 5,618,249, issued to Marshall Apr. 8, 1997, discloses a portable exercise device for the upper body of the user. The device comprises a belt to be worn about the user's waist. The front end of the belt contains a pouch which encloses a base. The base contains two recoilers. Two extension members having pulleys attached to their ends extend downwardly and outwardly from the base. Cords containing handles at their distal ends extend from the recoilers and pass over the pulleys. The recoilers may be adjusted to vary the force necessary to extend the cords.

U.S. Pat. No. 5,690,595, issued to Quinones Nov. 25, 1997, discloses an exercise device which is intended to exercise various portions of the body. The device is worn about the user's waist and contains an elastic belt having a pair of O-rings on each side. An elastic hose is attached at its proximal end to each pair of O-rings. The distal end of each elastic hose is attached to another pair of O-rings. A cover is attached to these distal O-rings and the cover contains weights which may be held by the user. Pulling the weights in various directions exercises the appropriate muscle groups.

U.S. Pat. No. 5,795,274, issued to Kasbohm Aug. 18, 1998, discloses a portable exercise device for exercising the muscles of the upper body. The device contains a belt which surrounds the waist of the user. A pulley housing having a pulley wheel is attached to the front of the belt.

While these devices are suitable for the intended purposes, the prior art still lacks a single device which is self-contained within a housing, may be used for a variety of arm exercises, has a curved ergonomic housing design to position properly on the user's body, and may be adjusted to vary the degree of force necessary to extend the handles.

BRIEF SUMMARY OF THE INVENTION

The device of the present invention is designed to overcome these disadvantages. The device of the present invention is an exercise device suited for use in the exercising of more than one group of arm muscles. The device contains a curved front and rear wall creating a curved ergonomic housing. The device has a series of anchor holes along top and bottom longitudinal pieces and an exit hole at each end of the device. There is a pulley just proximal to each exit hole. An anchor fits into one of the top or bottom anchor holes. Each of the anchors has one end of an elastic rope attached thereto. The elastic ropes wind around associated first pulleys, traverse the length of the device inside the device, wind around associated second pulleys, traverse the length of the device and exit the device at the exit holes in ferrules opposite the pulleys. The far ends of the ropes are attached to handles. The ropes may fit axially to or perpendicularly to the handles. Tension on the elastic ropes may be adjusted by placing the anchors at different locations along the top and bottom longitudinal pieces of the device.

The user may exercise triceps and back muscles by standing with the device pressed against the user's abdomen, holding the handles, and pulling the handles outwardly and upwardly. The biceps muscles may be exercised by sitting on the device, holding the handles, and curling the arms upwardly and rearwardly.

DETAILED DESCRIPTION OF THE INVENTION

Figure 1:
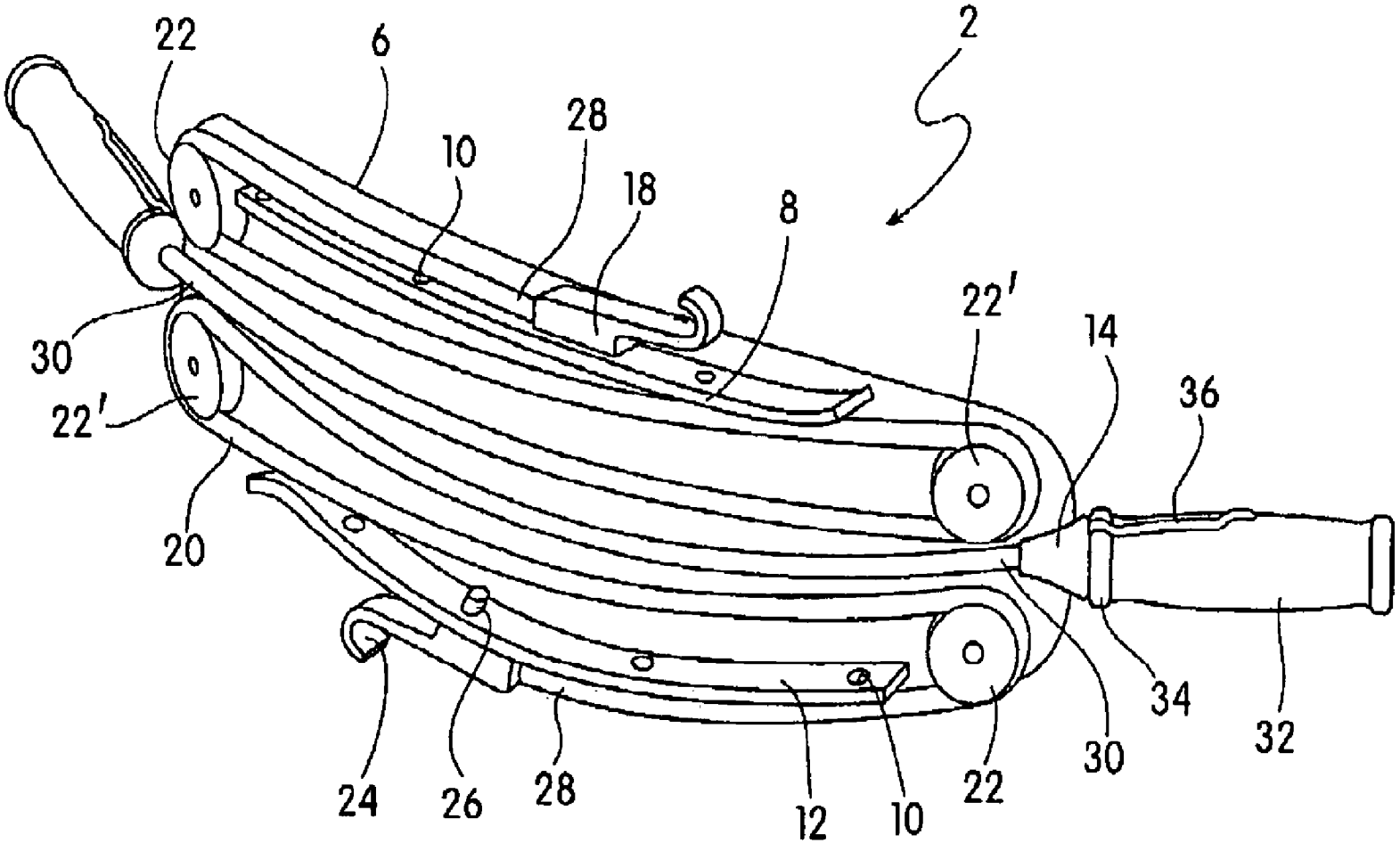
FIG. 1 is an elevational perspective cutaway view of the device of the present invention with the front wall removed.
Figure 2:
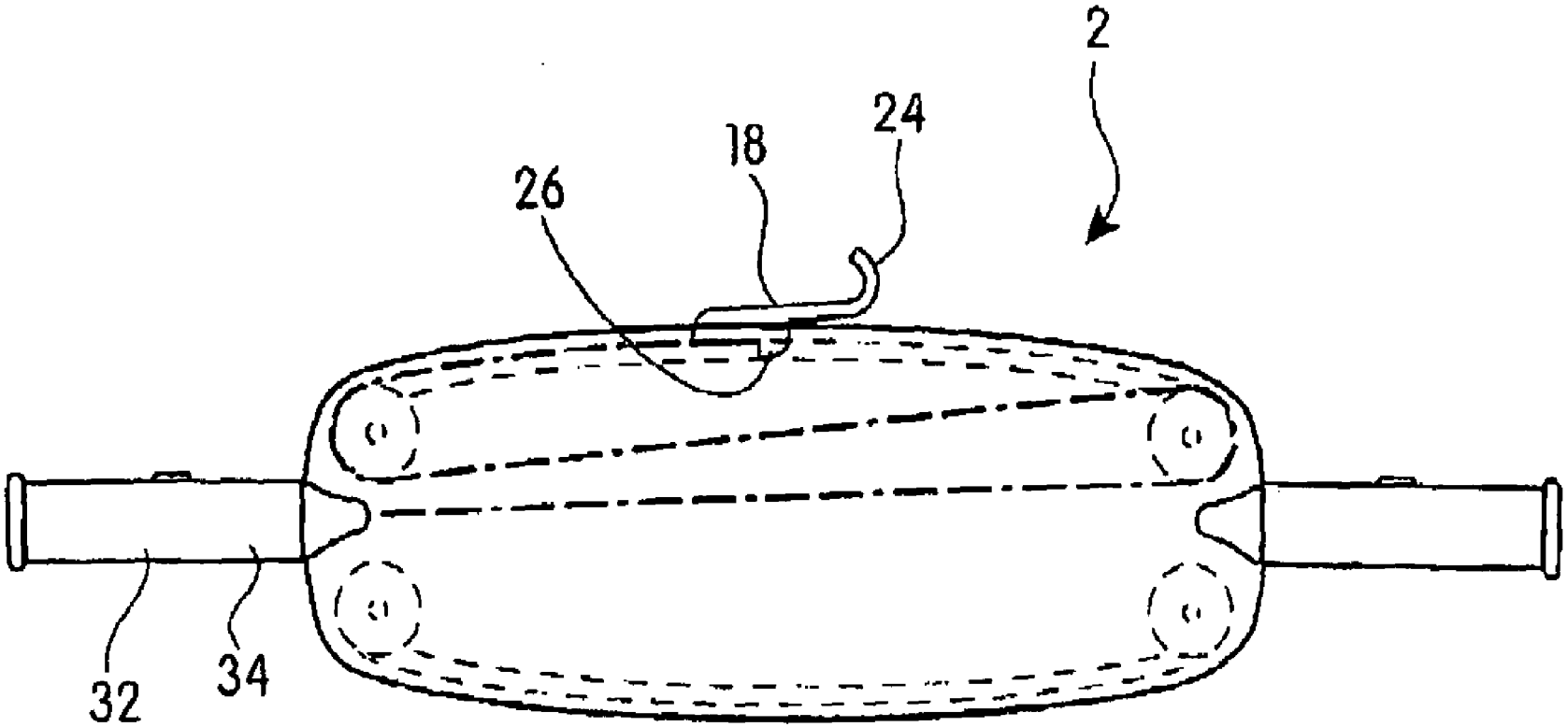
FIG. 2 is a front elevational view of the device of the present invention having phantom lines for showing the elastic ropes.
Figure 3:
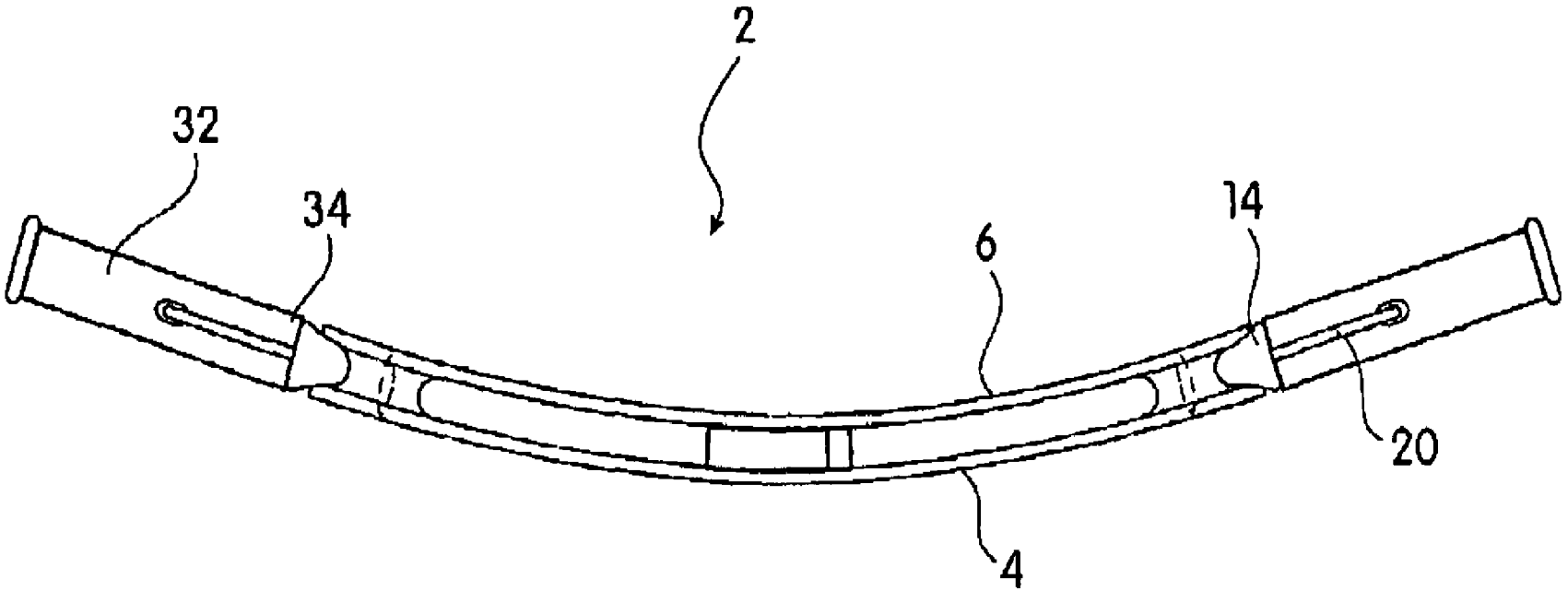
FIG. 3 is an elevational top view, partially in cutaway, of the device of this invention.
Figure 4:
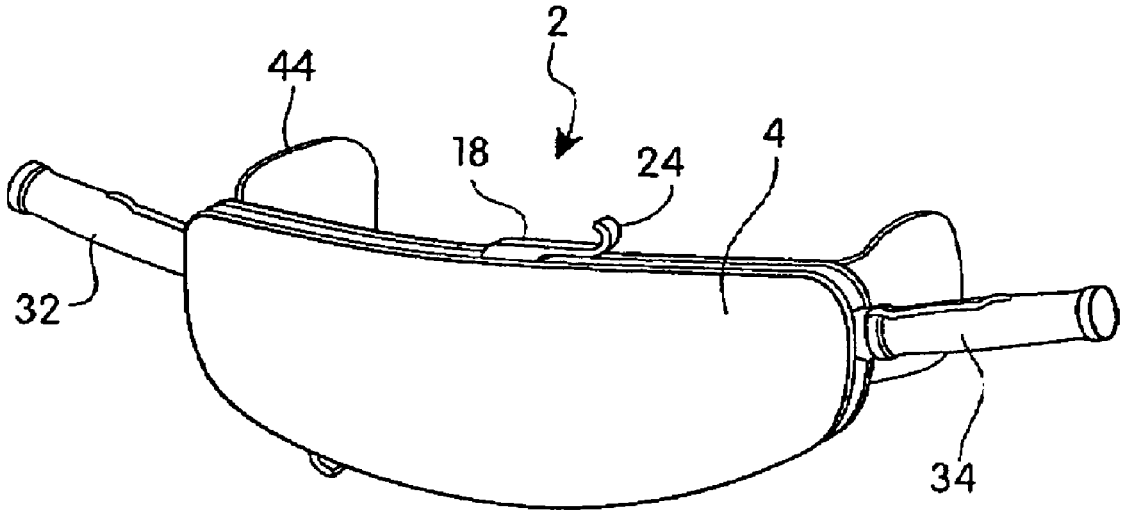
FIG. 4 is an elevational perspective view of the device of the present invention.
Figure 5:
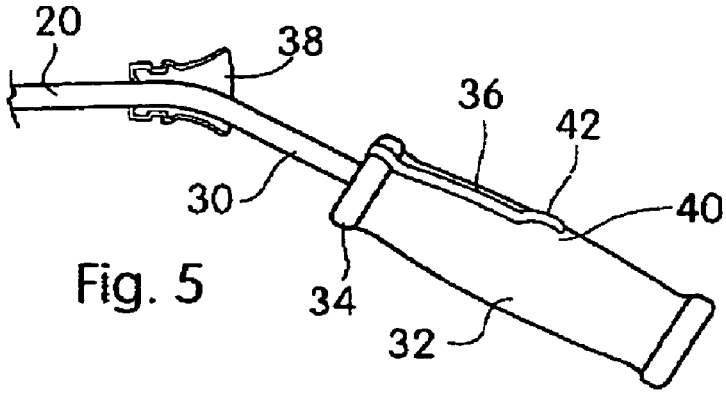
FIG. 5 is an elevational front view showing the relationship of the handle, elastic rope, and ferrule.

The invention will now be described with reference to the above drawings wherein like reference numerals refer to like features throughout.

The device 2 of the present invention contains a curved ergonomic housing made up in part of a curved front wall 4, a curved rear wall 6, a top longitudinal piece 8 having at least one anchor hole 10 therein, a bottom longitudinal piece 12 having at least one anchor hole 10 therein, and a pair of ferrules 14 having exit holes (not seen) therein.

The front 4 and rear 6 walls are parallel to each other and the arc of the front 4 and rear 6 walls is such that the device 2 presents an ergonomic housing which may fit comfortably against the user's abdomen when the user is standing or against the user's thighs when the user is sitting.

The top 8 and bottom 12 longitudinal pieces separate the front 4 and rear 6 walls and have a pair of anchors 18 on their outer aspects and a pair of self-contained resistance elastic means 20, a first pair of pulleys 22, a second pair of pulleys 22', and a pair of ferrules 14 having an exit hole in each ferrule 14 located between them. The thickness of each of the top 8 and bottom 12 longitudinal pieces is such as to withstand pressure transferred to it by virtue of the user pulling on the elastic means 20. Each of the top 8 and bottom 12 longitudinal pieces contains at least one anchor hole 10 passing therethrough. Four to six holes 10 are preferred. Five holes 10 will produce the most preferred results. The top 8 and bottom 12 longitudinal pieces allow control of the anchors 18 from the outside of the device 2.

Anchors 18 having handles 24 and anchor pins 26 capable of passing through the anchor holes 10 are removably attached to the top 8 and bottom 12 longitudinal pieces. The proximal ends 28 of the elastic means 20 are secured to the anchors 18. Preferably, the elastic means 20 are ropes. The ropes 20 pass inside the device 2, around first pulleys 22 which are adjacent to the ferrules 14 having exit holes therein, traverse the length of the device 2, pass around a second pulleys 22', traverse the length of the device 2, and exit through the exit holes in the ferrule 14 on the opposite end of the device 2.

Figure 6:
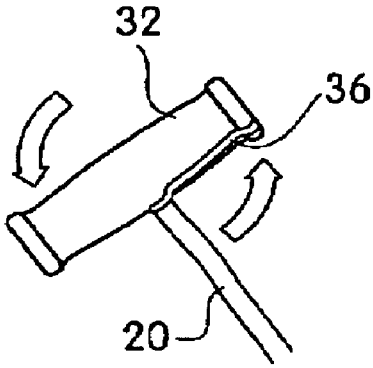
FIG. 6 is an elevational side view showing the perpendicular relationship between the elastic rope and the handle.
Figure 7:
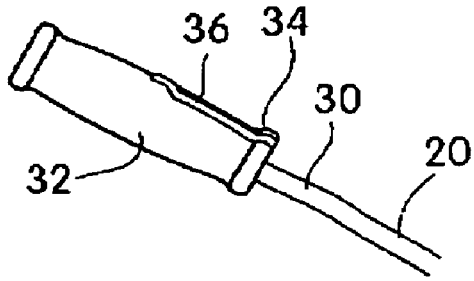
FIG. 7 is an elevational side view showing the linear relationship between the elastic rope and the handle.

The distal ends 30 of the ropes 20 are attached to handles 32. In one configuration, the ropes 20 are axial to the handles 32 and fit into the proximal ends 34 of the handles 32. This configuration, as shown in FIGS. 1–5, 7 and 8, allows the user to grasp the handles 32 axial to the ropes 20. In another configuration, slots 36 in the handles 32 allow the handles 32 and the ropes 20 to be arranged so that the ropes 20 are perpendicular to the handles 32. This arrangement is shown in FIGS. 6 and 9. By this arrangement, the user may grasp the handles 32 perpendicular to the ropes 20 in a natural manner for an exercise to be performed.

When the device 2 is in use, each anchor pin 26 is placed in an appropriate anchor hole 10. When placed in an anchor hole 10 near its respective first pulley 22, the rope 20 is shortened and the force necessary to extend the rope 20 is less. When placed in an anchor hole 10 removed from its respective first pulley 22, the rope 20 is lengthened and the force necessary to extend the rope 20 is greater. In this manner, the device 2 may be adjusted so that the desired tension required to perform a particular exercise is acquired.

The ferrule 14 is preferably made of low-friction plastic and the exit hole is wide at the distal end 38, allowing for a change in direction of the rope 20 without affecting the force necessary to extend the rope 20. This arrangement also reduces wear on the rope 20.

The handle 32 contains a central through hole (not shown) having a diameter large enough to permit the passage of the rope 20. Beyond the center of the handle 32 the through-hole opens into a cavity (not shown) which is of such a size as to permit the holding of the rope 20 tied in a simple overhand knot. This secures the rope 20 to the handle 32. A slot 36 in the handle 32 permits the rope 20 to lie axially to the handle 32 when the rope 20 lies in the slot 36 or perpendicular to the handle 32 when the rope 20 passes through a riser 40 in the handle 32 having a slot 42 therein. This allows for the rope 20 to be axial or perpendicular to the handle 32 and thus may be grasped by the user in such a way as to allow natural holding of the handle 32 to occur for particular exercises, especially the biceps exercise motion. The device 2 may contain a flap 44 extending from near each end 38 thereof. This flap 44 prevents chafing of the user.

In use, the rope 20 is extended when the desired muscles are contracted, thus bringing the handles 32 away from the device 2. The elastic quality of the rope 20 returns the handle 32 and the rope 20 to their starting position when tension applied by the muscles is lessened.

Figure 8:
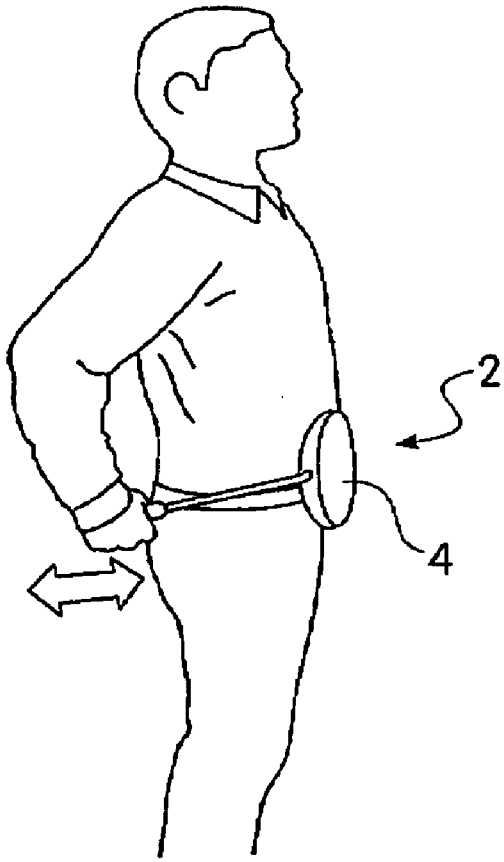
FIG. 8 is an elevational side view of a user using the device to exercise triceps muscles.
Figure 9:
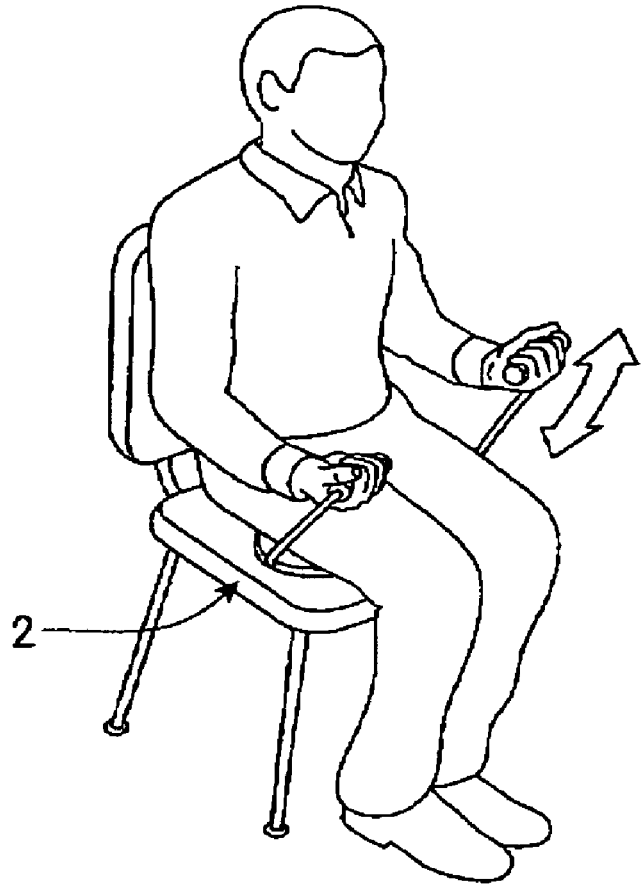
FIG. 9 is an elevational perspective view of a user using the device to exercise biceps muscles.

To exercise the triceps and muscles of the upper back, the user places the device 2 against the abdomen and grasps the handles 32 axially as shown in FIG. 8. By pulling the handles 32 rearwardly by contracting the triceps and upper back muscles, the desired muscles are exercised. Relaxation of the muscles allows the handles 32 to be returned to their original positions. The steps of contracting and relaxing the muscles may be repeated as often as desired.

To exercise the biceps, the user sits with the device 2 under the user's thighs as shown in FIG. 9. The handles 32 are grasped perpendicularly and pulled upwardly and rearwardly with the user's palms facing upward and the ropes 20 perpendicular to the handles 32. Also, with the ropes perpendicular to the handle 32 but with the user's palms facing downwardly, the user can pull his or her arms out straight from the body to perform a side lateral raise for the upper arm and lower shoulder region. Relaxation of the muscles allows the handles 32 to return to their original position. Alternatively, the handles 32 may be grasped axially and pulled upwardly and rearwardly to perform hammer curls and thus exercise a different muscle group.

Although the invention has been described and illustrated in detail, it is to be clearly understood that the same is by way of illustration and example, and is not to be taken by way of limitation. The spirit and scope of the present invention are to be limited only by the terms of the appended claims.

The invention claimed is:

1. An exercise device containing a curved substantially closed ergonomic housing having two opposite ends, each end having a ferrule having an exit hole therein, a top longitudinal piece having at least one anchor hole therein, a bottom longitudinal piece having at least one anchor hole therein, a pair of anchors which are removably fixed to the anchor holes, self-contained elastic ropes which pass through the ferrules and are attached at one end to the anchors within the housing, and attached at one end to handles outside of the housing.

2. The exercise device of claim 1, wherein the device contains a lust pair of pulleys and a second pair of pulleys.

3. The exercise device of claim 2, wherein the device contains a pair of ferrules having an exit hole in each ferrule and wherein each elastic rope is secured to its corresponding anchor, proceeds around its corresponding first pulley, traverses the inside of the device, proceeds around its corresponding second pulley, traverses the length of the device again, exits the device through the exit hole in its corresponding ferrule, and attaches to a corresponding handle.

4. The exercise device of claim 3, wherein there are four to six anchor holes in each of the top and bottom longitudinal pieces.

5. The exercise device of claim 4, wherein there are five anchor holes in each of the top and bottom longitudinal pieces.

6. The exercise device of claim 5, wherein the anchors are removably attached to the anchor holes by anchor pins.

7. The exercise device of claim 6, wherein the anchors have handles.

8. The exercise device of claim 7, wherein the ferrules are made of low-friction plastic and the exit hole is wide at the distal end thus allowing for a change in direction of the rope without affecting the force necessary to extend the rope.

9. The exercise device of claim 8, wherein the handles contain slots which permit the ropes to lie axially to the handles when the ropes lie in the slot or perpendicular to the handles when the ropes pass through a riser in the handle.

10. The exercise device of claim 9, wherein the device contains a flap extending from near each end thereof, which flap prevents chafing of the user.

11. A method of exercising triceps muscles and muscles of the upper back, comprising: (1) placing the device of claim 10 against the abdomen, (2) grasping the handles of the device axially, (3) pulling the handles rearwardly by contracting the triceps and muscles of the upper back, (4) relaxing of the contracted muscles to allow the handles to be returned to their original positions, and (5) repeating steps 3–4.

12. The method of exercising the biceps, comprising: sitting with the device of claim 10 under the thighs, grasping the handles of the device perpendicularly. pulling the handles upwardly and rearwardly with the user's palms facing upward and the ropes perpendicular to the handles.

* * * * *